US006536410B1

(12) United States Patent
Nehse

(10) Patent No.: US 6,536,410 B1
(45) Date of Patent: Mar. 25, 2003

(54) METHOD FOR SYNCHRONIZING IGNITION

(75) Inventor: Wolfgang Nehse, Reichling (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/959,385

(22) PCT Filed: Apr. 13, 2000

(86) PCT No.: PCT/EP00/03348

§ 371 (c)(1),
(2), (4) Date: Mar. 14, 2002

(87) PCT Pub. No.: WO00/65219

PCT Pub. Date: Nov. 2, 2000

(30) Foreign Application Priority Data

Apr. 24, 1999 (DE) ..... 199 18 664

(51) Int. Cl.[7] ..... F02P 5/00

(52) U.S. Cl. ..... 123/406.24; 123/406.53; 123/643

(58) Field of Search ..... 123/436, 406.24, 123/406.26, 406.27, 406.28; 701/111

(56) References Cited

U.S. PATENT DOCUMENTS 4,928,652 A * 5/1990 Shinya et al. ..... 123/417
5,503,008 A * 4/1996 Machida ..... 73/117.3
5,670,713 A * 9/1997 Machida ..... 73/116

FOREIGN PATENT DOCUMENTS

| | | |
|---|---|---|
| DE | 4122786 | 1/1992 |
| DE | 19744383 | 4/1998 |
| EP | 0640762 | 3/1995 |
| EP | 0684375 | 11/1995 |

* cited by examiner

*Primary Examiner*—Bibhu Mohanty
(74) *Attorney, Agent, or Firm*—Crowell & Moring LLP

(57) ABSTRACT

The invention relates to a method for synchronized ignition in an internal combustion engine with a crankshaft sensor and a device for detecting smooth running. The aim of the invention is to provide a method for synchronized ignition which does not require a camshaft sensor. After the engine has started, ignition takes place in all of the upper dead centers in at least one cylinder, the time of ignition being offset by a certain value each time that the crankshaft passes through 720°. The effect of offsetting the time of ignition is determined by the device for detecting the smoothness of running. Ignition is assumed to have occurred in the area of the upper dead center in which the ignition time is offset when the smoothness of running is modified above a predetermined limit value or is assumed to have occurred in the area of the upper dead center in which the ignition time is not offset when the smoothness of running is not modified above a predetermined limit value.

12 Claims, 2 Drawing Sheets

METHOD FOR SYNCHRONIZING IGNITION

BACKGROUND AND SUMMARY OF THE INVENTION

The invention relates to a method for a synchronized ignition in an internal-combustion engine with a crankshaft sensor and a device for detecting smooth running.

In the case of a four-stroke engine, the operating cycle comprises the intake, the compression, the working and the discharge operations, in which case each cylinder moves up and down twice and in this case comes to a stop in two upper (top) dead centers (OT) and two lower dead centers (UT). Thus, during one operating cycle, the crankshaft carries out two rotations; the camshaft carries out one rotation. The ignition of the gas-fuel mixture charged in a cylinder takes place at an upper dead center in which the mixture has just been compressed. This is the ignition upper dead center (ZOT). In contrast, there is also an overlapping upper dead center (ÜTO) in which, during the transition from the discharge to the intake, the inlet as well as the outlet valves are opened.

When a crankshaft sensor is used, it can be determined when an upper dead center is present. However, it cannot easily be determined whether this is the ignition upper dead center or the overlapping upper dead center. For differentiating between these upper dead centers, a camshaft sensor is conventionally used which indicates the ignition upper dead center.

Without such a camshaft sensor, ignitions had to be implemented in the ignition upper dead center as well as in the overlapping upper dead center. Furthermore, without a precise differentiation between the ignition upper dead center and the overlapping upper dead center, no fully sequential cylinder injection can be implemented.

From German Patent Document DE 41 22 786 A1, a method is known for the identification of the angle of rotation of an internal-combustion engine assigned to an ignition or injection operation. According to an embodiment, for starting the engine, an ignition operation is first initiated each time the angle of rotation is reached. After the start, such an ignition operation is initiated only at each second reaching of the angle of rotation, a conclusion being drawn on the crank angle from the comparison of an actual reaction and a desired reaction. In this case, it is a disadvantage that unburnt fuel/air mixture can reach a catalyst on the output side and can burn there.

Disadvantages of an ignition at both upper dead centers a less smooth running, a higher consumption, higher emissions, a more extensive spark plug wear and a so-called "exhaust backfire".

In contrast, when a separate camshaft sensor is used, additional costs are required for the sensor or the sensor wheel and the additional periphery.

It is an object of the invention to provide a method for a synchronized ignition in which the ignition upper dead enter can be determined without a camshaft sensor.

This object is achieved by a method for a synchronized ignition in an internal-combustion engine having a crankshaft sensor as well as a device for detecting smooth running, characterized in that, (a) after the start of the vehicle, an ignition takes place at least in one cylinder in all upper dead centers (OTs), a shifting of the ignition point in time taking place by a defined value in certain upper dead centers; (b) the effect of the ignition point in time adjustment is detected by way of the detection of the smooth running; and (c) an ignition upper dead center is assumed in the upper dead center in which the shift of the ignition point of time is taking place if the running smoothness changes above a defined limit value, and an ignition upper dead center is assumed in the upper dead center in which no shift of the ignition point in time is taking place if the running smoothness does not change above a defined limited value.

Accordingly, immediately after the start, an ignition is carried out at least in one cylinder at all upper dead centers (OT), a shifting of the ignition point in time taking place at certain upper dead centers, particularly at each second upper dead center, thus all 720__ of crankshaft angle. According to whether the air-fuel mixture is actually ignited at the upper dead center (OT) at which the shift of the ignition point in time is carried out, or at a crankshaft angle shifted by 360__, a reduction of the indicated work in the respective cylinder can be determined.

Such a reduction of the indicated work can be determined by means of a device for detecting smooth running. If an effect in the smooth running can now be detected by the shift of the ignition angle, the shift of the ignition point in time has taken place in the upper dead center in which an ignition of the air-fuel mixture is actually taking place. If, however, the smooth running does not significantly change as the result of the shift of the ignition point in time, the ignition is taking place in the overlapping upper dead center.

Preferably, a retarding of the ignition angle is selected as the ignition angle shift.

Furthermore, for a further protection and checking of the result of the synchronized ignition, it can be attempted to carry out a countercheck such that the shift of the ignition point in time is in each case offset by 360°. In the case of a correctly functioning ignition time synchronization, a modification of the smooth running must occur, if there previously was no modification of the smooth running or, vice-versa, a normal smooth running must be present if, before the countercheck, the running was very erratic.

As an alternative to the countercheck, the ignition in other cylinders can be tested, preferably corresponding to their firing sequence.

If the ignition upper dead center was detected in its position with respect to the crankshaft, a change to the normal operation with a single-plug ignition can only take place in the ignition upper dead center. In addition, it is advantageous in this connection to also switch over to a fully sequential injection.

On the whole, the present method offers a simple and cost-effective solution for an effective synchronized ignition. In particular, the costs for a camshaft sensor and its attendant peripheral components can be saved without the requirement of doing without a single-plug ignition or an operation in the fully sequential mode.

Also with respect to additional advantages and characteristics, the invention will be described in detail in the following by means of an embodiment and with respect to the attached drawings.

DETAILED DESCRIPTION OF THE DRAWINGS

Figure 2:
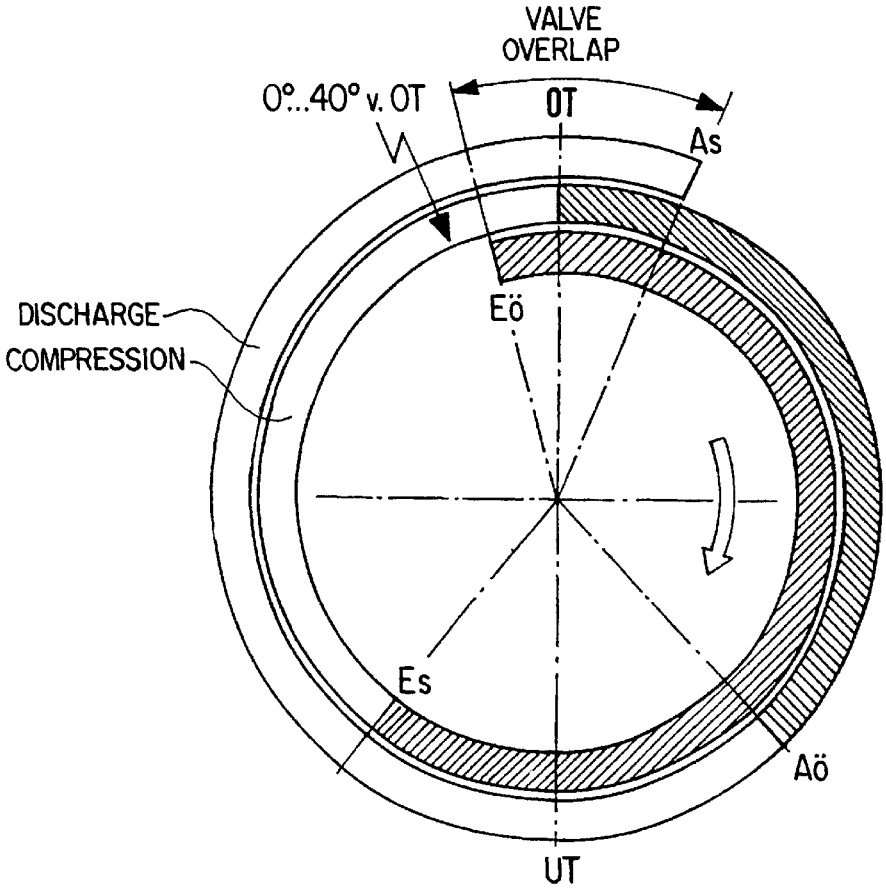
FIG. 2 is a known control diagram of a four-stroke Otto engine.

The operating cycle of a four-stroke Otto engine known per se is easily visible in the control diagram in FIG. 2, in which the opening and closing times of the inlet and outlet valves are entered as angles in degrees of crankshaft rotations. The intake stroke is limited by the events "inlet valve opens" (Eö) and "inlet valve closes" (Es). The compression stroke is limited by the events "inlet valve closes" (Es) and the upper dead center (OT). The working stroke is limited by the above-mentioned upper dead center (OT) and the event "outlet valve opens" (Aö). The discharge stroke is finally limited by the events "outlet valve opens" (Aö) and "outlet valve closes" (As). An overlapping of the opening times of the inlet and outlet valve takes place during the intake and discharge stroke.

During one working cycle, the crankshaft carries out two complete rotations, each cylinder travelling through two upper dead centers (OT) and two lower dead centers (UT). Approximately 0° to 40° in front of the upper dead center (OT), at which the compression has taken place, the actual ignition takes place of an air-fuel mixture charged in the corresponding cylinder. This is the ignition upper dead center (ZOT). In contrast, the upper dead center in the transition area from the discharge to the intake is called an overlapping upper dead center (ÜOT).

Figure 3:
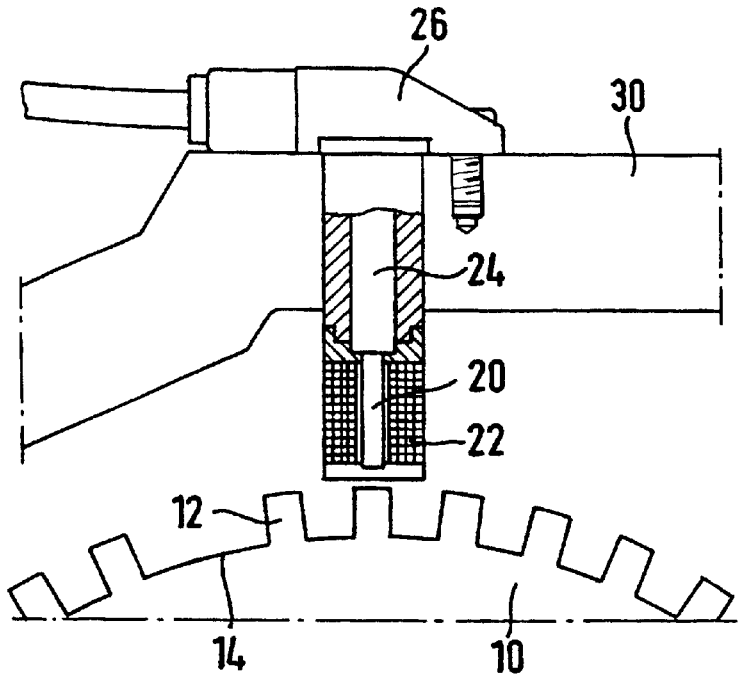
FIG. 3 is a partial sectional view of a known crankshaft sensor.

The position of the crankshaft can be detected, for example, by means of a crankshaft sensor. A partial view of the known crankshaft sensor is illustrated in FIG. 3. At the crankshaft (which is not shown), a sensor wheel 10 is arranged which has lugs 12 and a reference mark 14. A sensor situated opposite the sensor wheel and consisting of a soft-iron core 20, a winding 22 and a permanent magnet 24 is accommodated in a housing 26 which is fastened to the engine power section 30.

Figure 4:
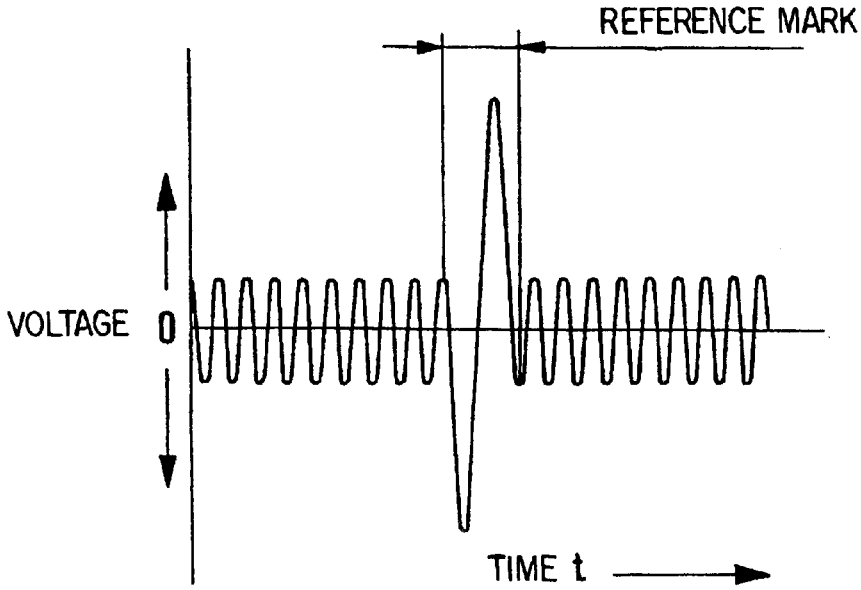
FIG. 4 is a diagram with a course of the pulse for the rotational speed and the crankshaft position in the case of a crankshaft sensor according to FIG. 3.

During a rotation of the crankshaft, the above-described induction sensor generates a signal which has a voltage course illustrated in FIG. 4 over the time t. During each crankshaft rotation, the reference mark 14 is passed once, so that the rotational speed and the crankshaft position can be detected in a precise manner during a rotation.

However, by means of the above-described crankshaft sensor, it cannot be determined whether one is located in the intake or in the working cycle. So far, a camshaft sensor has been used for this purpose.

As a result of the present method according to the invention, however, a separate camshaft sensor can be eliminated. For initializing the crankshaft position, an ignition is first carried out at all upper dead centers (OT) in a first time period after the start of the internal-combustion engine.

Figure 1:
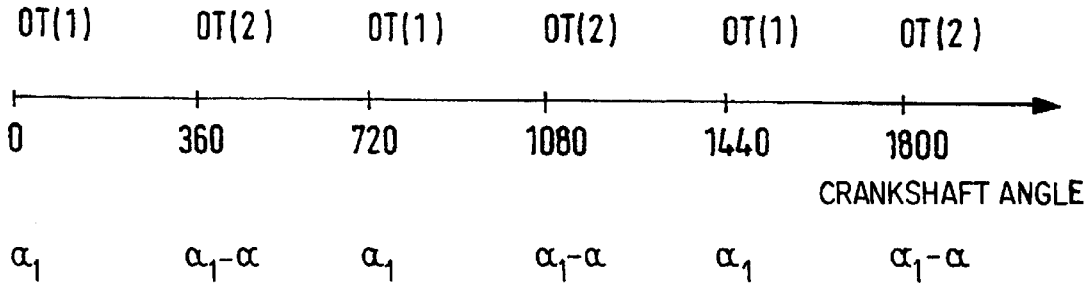
FIG. 1 is a diagram by means of which the ignition angle shift is explained in detail as a function of a crankshaft angle in an embodiment of the invention.

FIG. 1 illustrates the first five crankshaft rotations. In this case, at crankshaft angles 0°, 720° and 1,440°, currently a normal ignition takes place having the ignition values $\alpha_1$, defined in a characteristic diagram. However, every 720° of crankshaft angle, thus currently at crankshaft angles of 360°, 1,080° and 1,800°, the ignition angle is retarded by a defined value $\alpha$, so that, at these ignition points in time, a late ignition takes place which has the ignition angle $\alpha_1-\alpha$.

If the retarding of the ignition angle now takes place at an upper dead center at which an air-fuel mixture is actually ignited in the cylinder to be checked, the running smoothness will be modified. If, on the other hand, the retarding of the ignition angle takes place at the upper dead center in which no compressed air-fuel mixture is present, thus in the overlapping upper dead center (ÜOT), the running smoothness essentially does not change.

A modification of the running smoothness can be defined by means of a device for detecting smooth running. Such smooth running detection devices are known in large numbers from the prior art and will not be described here in detail. However, it is, for example, possible to evaluate with respect to time the signal illustrated in FIG. 4 in regard to its reversal points.

On the whole, it can be determined by means of the present method whether an upper dead center of the crankshaft is an ignition upper dead center or an overlapping upper dead center.

Once this has been determined, the ignition can be switched over to a single-plug ignition at the ignition upper dead center which will then be known. In parallel, a switchover can then also take place to a fully sequential injection into the cylinders.

By means of the above-described method, it is easily possible to save the camshaft sensor without the requirement of having to do without a single-plug ignition.

What is claimed is:

1. A synchronized ignition method for an internal combustion engine having a crankshaft sensor and a smooth running detecting device, the method comprising the acts of:

after starting the engine, performing an intended ignition at least in one cylinder in all upper dead centers, wherein a shifting of an ignition point in time takes place by a defined value in certain ones of the upper dead centers;

detecting, via the smooth running detecting device, an effect of the shifting of the ignition point in time; and if a running smoothness changes above a defined limit value for an upper dead center in which the shifting of the ignition point in time takes place, then assigning that upper dead center as an ignition upper dead center, and if the running smoothness does not change above a defined limit value in the upper dead center in which the shifting of ignition point of time takes place, then assigning the upper dead center in which no shifting of the ignition point in time takes places as the ignition upper dead center.

2. The method according to claim 1, wherein the shifting of the ignition point in time occurs every 720° crankshaft angle in every second upper dead center.

3. The method according to claim 1, wherein a retarding of the ignition angle is carried out as an ignition angle shift.

4. The method according to claim 2, wherein a retarding of the ignition angle is carried out as an ignition angle shift.

5. The method according to claim 1, wherein the upper dead centers in which a shifting of the ignition point in time occurs are offset by 360°, respectively.

6. The method according to claim 2, wherein the upper dead centers in which a shifting of the ignition point in time occurs are offset by 360°, respectively.

7. The method according to claims 3, wherein the upper dead centers in which a shifting of the ignition point in time occurs are offset by 360°, respectively.

8. The method according to claim 1, wherein several cylinders of the internal combustion engine are tested successively according to an ignition sequence.

9. The method according to claim 2, wherein several cylinders of the internal combustion engine are tested successively according to an ignition sequence.

10. The method according to claim 3, wherein several cylinders of the internal combustion engine are tested successively according to an ignition sequence.

11. The method according to claim 5, wherein several cylinders of the internal combustion engine are tested successively according to an ignition sequence.

12. The method according to claim 1, wherein, after synchronizing the ignition, a switch-over takes place to at least one of a single-plug ignition and a fully sequential injection of the cylinders.

* * * * *